US007047965B1

(12) United States Patent
Ball

(10) Patent No.: US 7,047,965 B1
(45) Date of Patent: May 23, 2006

(54) FRESH AIR SWIMMING SNORKEL

(76) Inventor: Edwin K. Ball, 8551 - 113B Street, Delta, BC (CA) V4C 5G3

( * ) Notice: Subject to any disclaimer, the term of this patent is extended or adjusted under 35 U.S.C. 154(b) by 0 days.

(21) Appl. No.: 11/063,598

(22) Filed: Feb. 24, 2005

(51) Int. Cl.
*B63C 11/16* (2006.01)

(52) U.S. Cl. ..... 128/201.11; 128/201.27

(58) Field of Classification Search ..... 128/201.11, 128/201.28, 201.27, 207.11, 206.27, 207.17
See application file for complete search history.

(56) References Cited

U.S. PATENT DOCUMENTS 2,753,865 A 7/1956 Van der Kogel
3,860,042 A 1/1975 Green
5,117,817 A 6/1992 Lin
5,664,558 A 9/1997 Wagner
5,697,362 A 12/1997 Albrecht
D406,333 S 3/1999 Garraffa
6,085,744 A 7/2000 Hermansen et al.
6,302,102 B1 10/2001 Giroux et al.
6,318,363 B1 11/2001 Monnich

*Primary Examiner*—Mital Patel
(74) *Attorney, Agent, or Firm*—Oyen Wiggs Green & Mutala

(57) ABSTRACT

A front-mounted swimming snorkel with separate air intake and exhaust tubes controlled by one-way valves to prevent re-breathing exhaled air, wherein the exhaust tube cross-sectional area is selected to regulate the amount of force needed to open the water purge valve so that a swimmer can open the purge valve by exhaling with more force than normal.

13 Claims, 9 Drawing Sheets

FRESH AIR SWIMMING SNORKEL

TECHNICAL FIELD

The invention relates to swimming aids and more particularly to snorkels for use as recreational and fitness training swimming aids.

BACKGROUND

Swimmers in a swimming pool or an open body of water often use the front crawl stroke, where in order to breathe, a swimmer must either lift his or her head or rotate it to one side, which also rotates and disrupts the body alignment. While diving snorkels have long been used to permit divers to breathe when near the surface of the water without lifting their heads from the water, snorkels have only recently been developed to allow swimmers to breathe while using the front crawl or other strokes without lifting or turning their heads.

For example, a center-mount swimmer's snorkel patented under U.S. Design Patent no. Des 406,333 by Finis, Inc. has a snorkel tube positioned in front of the user's forehead and secured by a head-brace, which extends above the water surface and has at its lower end a mouthpiece held in the user's mouth and a water purge valve. One problem with the Finis, Inc. device however is that the user re-breathes their own exhaled air containing relatively high concentrations of carbon dioxide which causes dizziness and rapid breathing together with fatigue and head-aches.

Another problem with the Finis snorkel is that small amounts of accumulated water cannot be released because the water purge valve located below the mouth piece will not open during forceful exhalations due to the wide diameter of the breathing tube required for inhalation, and the water purge valve will only open when water has accumulated along the lower portion of the breathing tube up to the level of the mouthpiece, at which point an exhalation more forceful than normal combines with the downward pressure of the accumulated water to produce enough pressure to open the water purge valve to release most of the accumulated water. Thus the Finis swimming snorkel does not purge water effectively.

A side-mounted swimmer's snorkel is disclosed in U.S. Pat. No. 6,318,363 by Monnich. As in the Finis design, users re-breathe air remaining in the snorkel tube from the previous exhalation, resulting in dizziness and an increased pulse rate. Accumulated water in the breathing chamber can be released at any time by a forceful exhalation which triggers one-way adjustable flap-valves to close and block both breathing tubes, causing the water purge valve to open. The flap-valves need continued adjustment to close with the desired amount of pressure, and the water purge valve stays open during the entire forceful exhalation, releasing a large amount of air bubbles which produce noise and vibration. Another problem with the Finis snorkel is that the head brace is at a fixed angle relative to the mouthpiece tube, so it does not accommodate swimmers with differently shaped foreheads.

There is a need for a swimming snorkel for use in recreational and fitness training which prevents users from re-breathing their exhaled air, and allows easy purging of accumulated water.

SUMMARY OF INVENTION

The invention provides a swimming snorkel with separate intake and exhaust airways each regulated by one-way check valves. The lower end of each airway communicates with a chamber connected to the mouthpiece and a water purge valve. The exhaust airway has a cross-sectional area along its entire length, or a portion of its length, which is large enough so that a swimmer does not need to expend extra force to exhale, yet sufficiently small to cause the water purge valve to open when a swimmer exhales with more force than normal.

The invention provides a swimming snorkel for use by a swimmer while swimming on or adjacent the surface of the water comprising: (a) a mouthpiece; (b) an elongated hollow intake airway having upper and lower ends and communicating between the mouthpiece and air outside the snorkel; (c) a one-way intake valve means in the intake airway for permitting the intake of air and preventing the exhaust of air; (d) an elongated exhaust airway having upper and lower ends and communicating between the mouthpiece and air outside the snorkel; (e) one-way exhaust valve means in the exhaust airway for preventing the intake of air and permitting the exhaust of air; (f) a hollow chamber communicating with the mouthpiece and the lower ends of the intake airway and the exhaust airway and communicating with a purging passage for purging air and water; (g) one-way purge valve means in the purging passage for preventing the intake of air or water and permitting the exhaust of air and water; (h) means for releasably securing the snorkel to the head of the swimmer, whereby the mouthpiece is held in the mouth of the swimmer and the upper ends of the intake airway and the exhaust airway extend above the surface of the water when the head and body of the swimmer are on or adjacent to the surface of the water; wherein the exhaust airway has a cross-sectional area selected to be sufficiently small in at least one section thereof to cause the one-way purge valve to open to release accumulated water when a swimmer exhales with more force than normal, and large enough so that the swimmer can exhale in a normal manner through the exhaust airway while swimming without opening the one-way purge valve means.

According to one aspect of the invention, the amount of exhaling force needed to open the water purge valve can be reduced or increased by rotating a butterfly valve that protrudes into the exhaust airway, which changes the cross-sectional area of a portion of the exhaust airway affecting the amount of exhaling force needed to open the water purge valve. The invention also provides a method of using the improved swimming snorkel.

BRIEF DESCRIPTION OF DRAWINGS

In drawings which describe preferred embodiments of the invention:

FIG. 1 is a side elevation view of a first embodiment of the invention in use by a swimmer.

FIG. 4A is a lower end view of the valve assembly shown in FIG. 4.

FIG. 4B is a side view of the valve assembly shown in FIG. 4.

FIGS. 4C, 4D and 4E are cross-sectional views of the breathing tube shown in FIG. 4.

FIG. 4F is an end view, partially in cross-section of the mouth-piece and hollow chamber shown in FIG. 1.

FIG. 4H is a cross-section of the valve assembly shown in FIG. 4 with the butterfly valve shown in the closed position.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
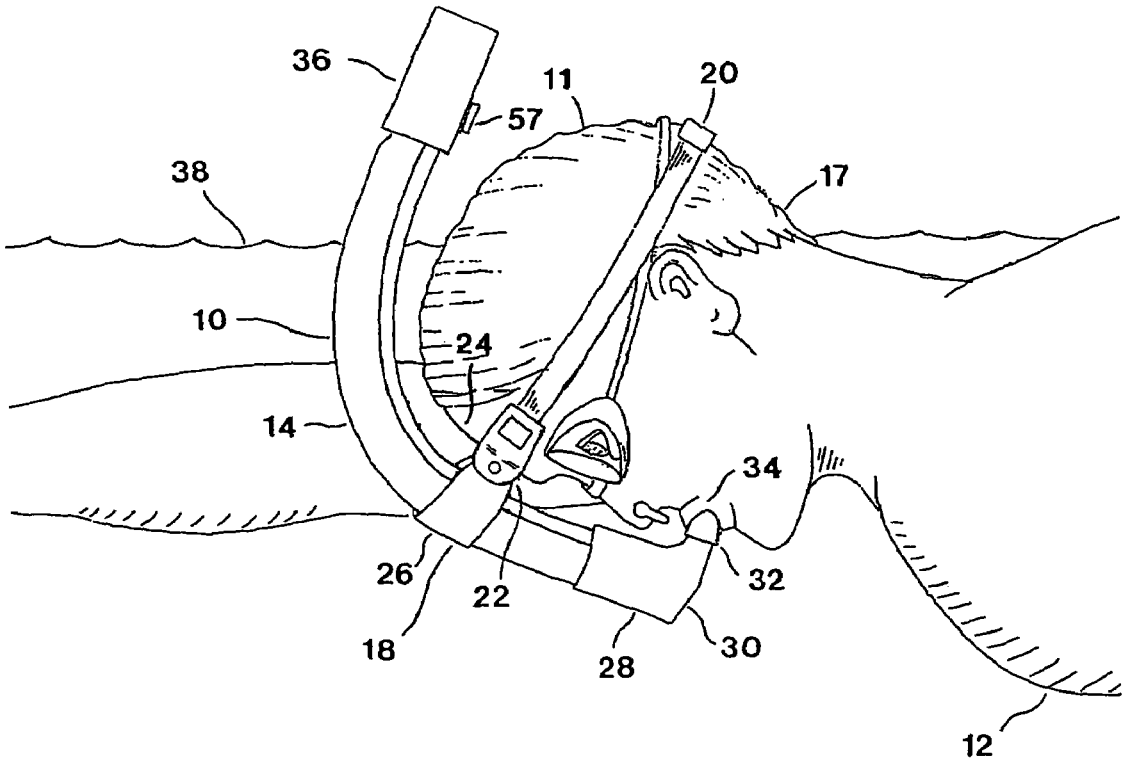
FIG. 1 is

With reference to FIG. 1, a swimming snorkel 10 according to the invention is in use by a swimmer 12. The snorkel 10 has a curved breathing tube 14 which is secured to the head 11 of the swimmer by a brace assembly 18 which comprises an adjustable, flexible rubber strap 20, a forehead brace 22 which is secured to the strap 20 and bears against the swimmer's forehead 24, and is hingedly connected to an adjustable tube-mounting element 26 secured to forehead brace 22 which slidingly receives the breathing tube 14. Adjustable tube mounting element 26 moves on breathing tube 14 and is connected by hinge rod 23 with forehead brace 22 to form a hinge that allows rotation of mounting element 26.

Tube 14 is connected to hollow chamber 28, which has water purge exit passage 30 (FIG. 2) and is connected to mouthpiece 32 which is held in the mouth 34 of the swimmer. Tube 14, with a valve assembly 36 and an adjustable threaded butterfly valve 57 at its upper end, curves through an angle of approximately 90 degrees from chamber 28 to valve assembly 36 and is sufficiently long, generally about fifteen inches, so that the valve assembly 36 extends above the water line 38 when the swimmer's head 11 and body 17 are horizontally oriented during swimming.

Figure 2:
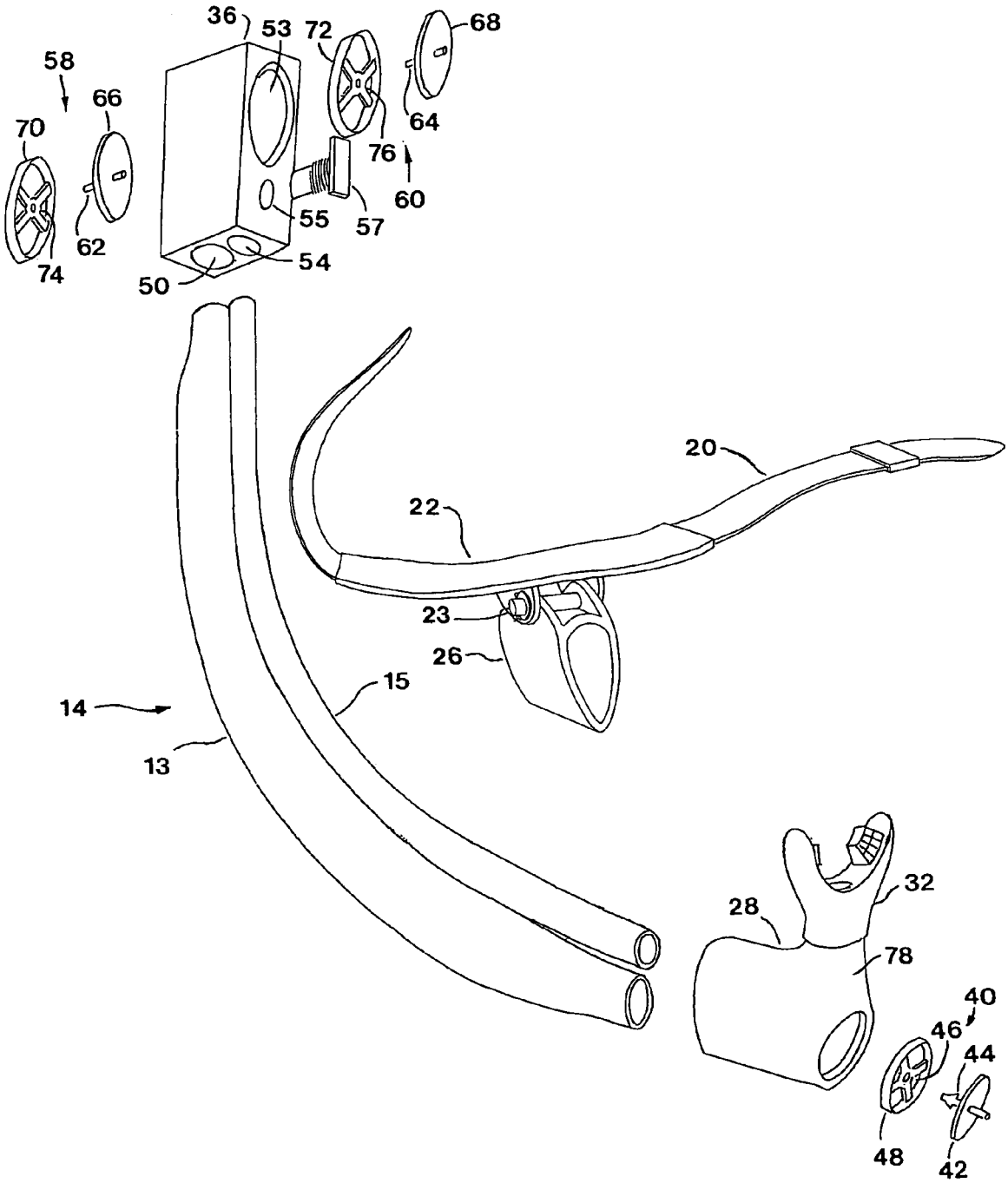
FIG. 2 is an exploded perspective view of the embodiment of the invention shown in FIG. 1.
Figure 3:
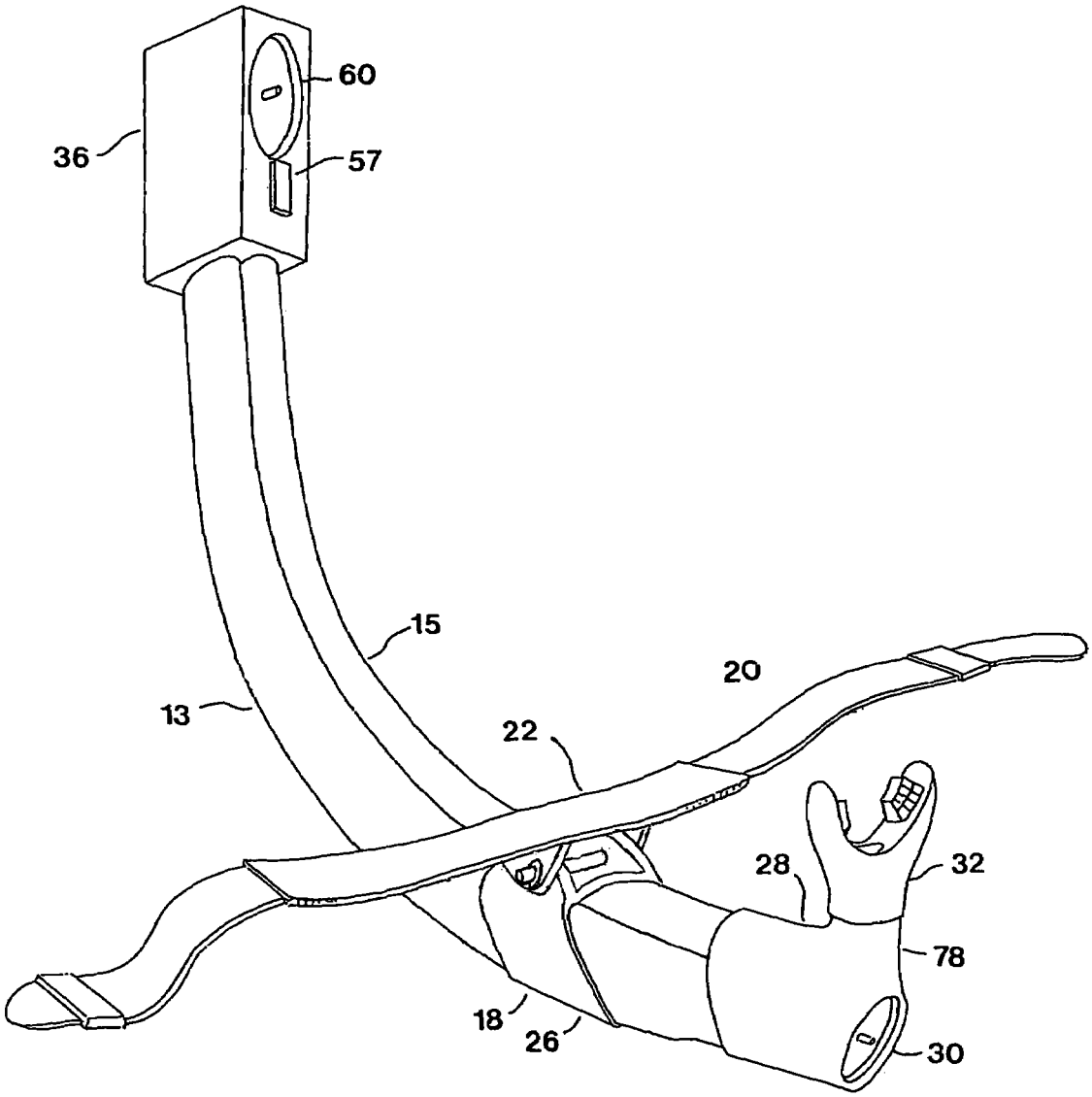
FIG. 3 is a perspective view of a first embodiment of the invention.
Figure 4:
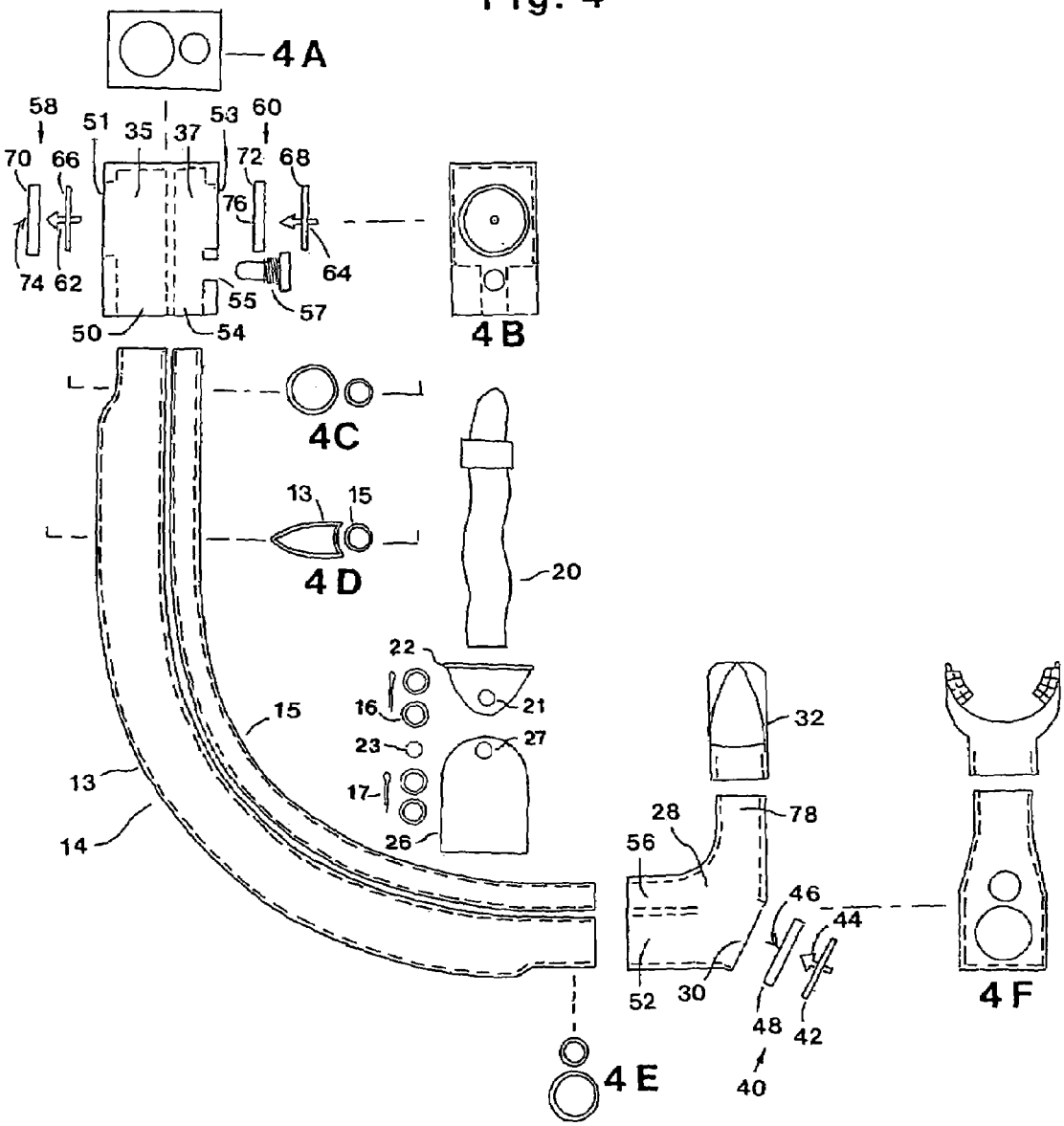
FIG. 4 is an exploded side view of the embodiment of the invention shown in FIG. 1.

With reference to FIGS. 2 through 4, tube 14 comprises hollow intake tube 13 and exhaust tube 15. Valve assembly 36 is divided into intake chamber 35 and exhaust chamber 37. Intake chamber 35 communicates with intake passage 51 and intake tube port 50. Exhaust chamber 37 communicates with exhaust passage 53 and exhaust tube port 54. Threaded hole 55 extends through the wall of exhaust chamber 37 and receives threaded butterfly valve 57 to form a compression seal along the surface of the threads that does not allow the entry of air or water. Intake tube port 50 and exhaust tube port 54 receive the upper ends of intake tube 13 and exhaust tube 15. Intake passage 51 and exhaust passage 53 have one-way valves 58, 60 respectively which comprise flexible silicone valve diaphragms 66, 68 having central stems 62, 64 which are secured in central apertures 74, 76 of valve seats 70, 72. More than one one-way valve may be provided for either or both the intake or the exhaust passages.

Hollow chamber 28 communicates with mouthpiece passage 78, purge exit passage 30, intake tube port 52 and exhaust tube port 56. Intake tube port 52 and exhaust tube port 56 receive the lower ends of intake tube 13 and exhaust tube 15. Water purge exit passage 30 is closed by a one-way valve 40 comprising a flexible silicone valve diaphragm 42 having a central stem 44 which is secured in a central aperture 46 of valve seat 48.

Figure 4G:
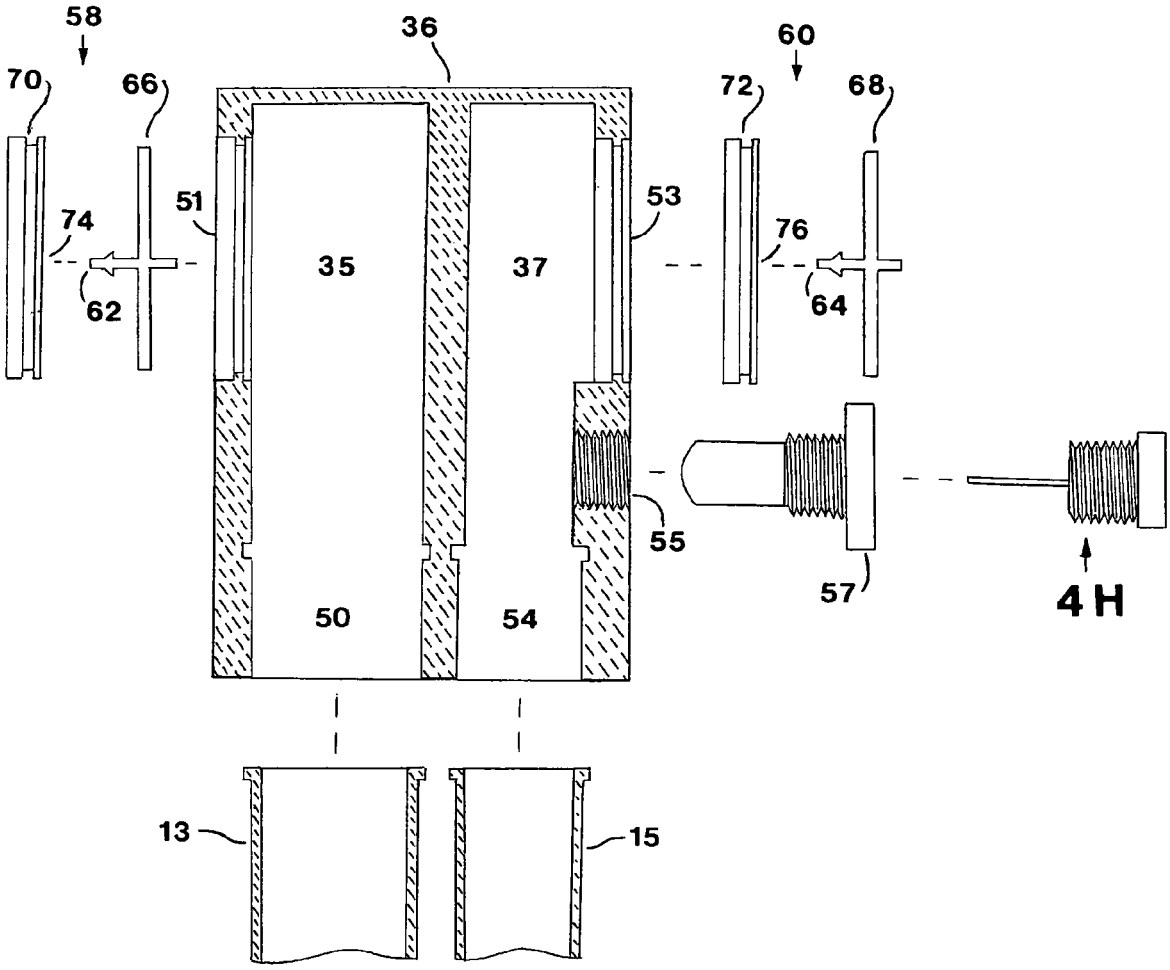
FIG. 4G is a detail cross-section view of the valve assembly shown in FIG. 4 with the butterfly valve shown in the open position.

As shown in cross-section in FIGS. 4C, 4D and 4E, while the upper and lower ends of inlet tube 13 are preferably circular in cross-section, the rest of inlet tube 13 has an arrowhead or bullet-shaped cross-section to reduce the hydrodynamic drag while swimming for reduced resistance through the water. Other shapes may be used to accomplish the same result. However the intake tube 13 should have a minimum cross-sectional area of about 0.44 square inch (0.75 inch circular diameter), so that a minimum amount of force is needed to inhale. FIG. 4G shows the valve assembly 36, and FIG. 4H shows the threaded butterfly valve 57 in closed position.

Figure 4J:
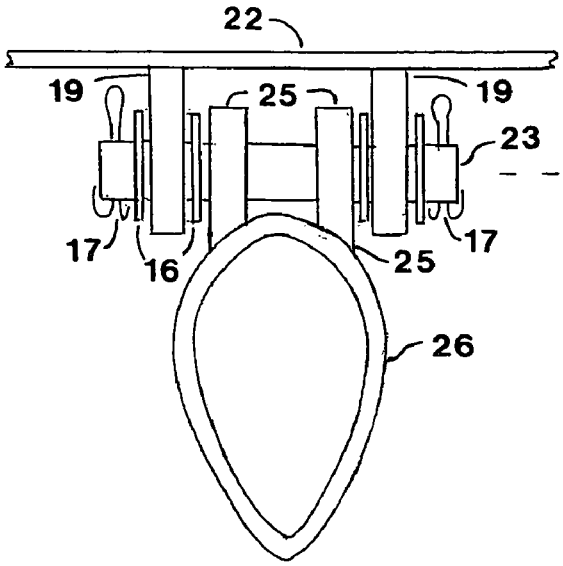
FIGS. 4J and 4K are detail views of the head brace connection of the invention.
Figure 4K:
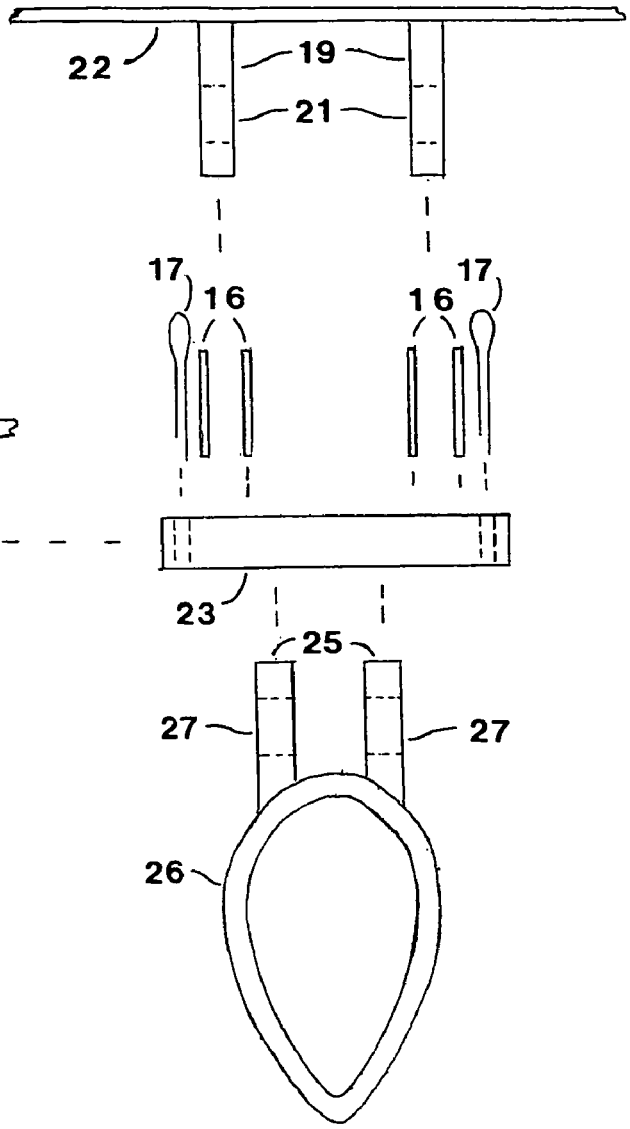
Figure 5:
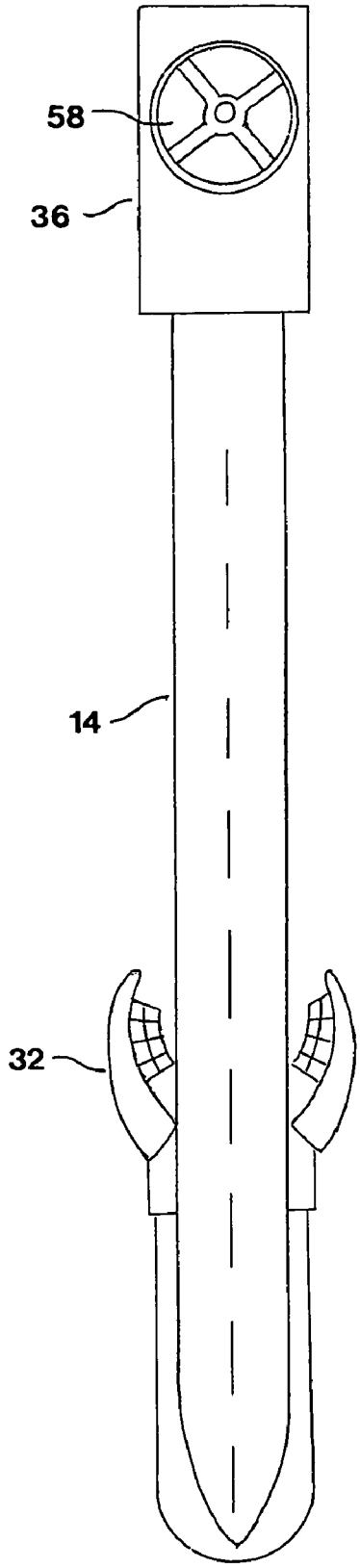
FIG. 5 is a front view of the embodiment of the invention shown in FIG. 2.

As shown in FIGS. 4J and 4K, adjustable tube mounting element 26 is connected to forehead brace 22 by hinge rod 23 which extends through holes 27 in extending arms 25 and holes 21 in extending arms 19 and is secured with washers 16 and cotter pins 17. The tube mounting element is thereby hinged on forehead brace 22 and moveable about the axis defined by hinge rod 23.

Figure 6:
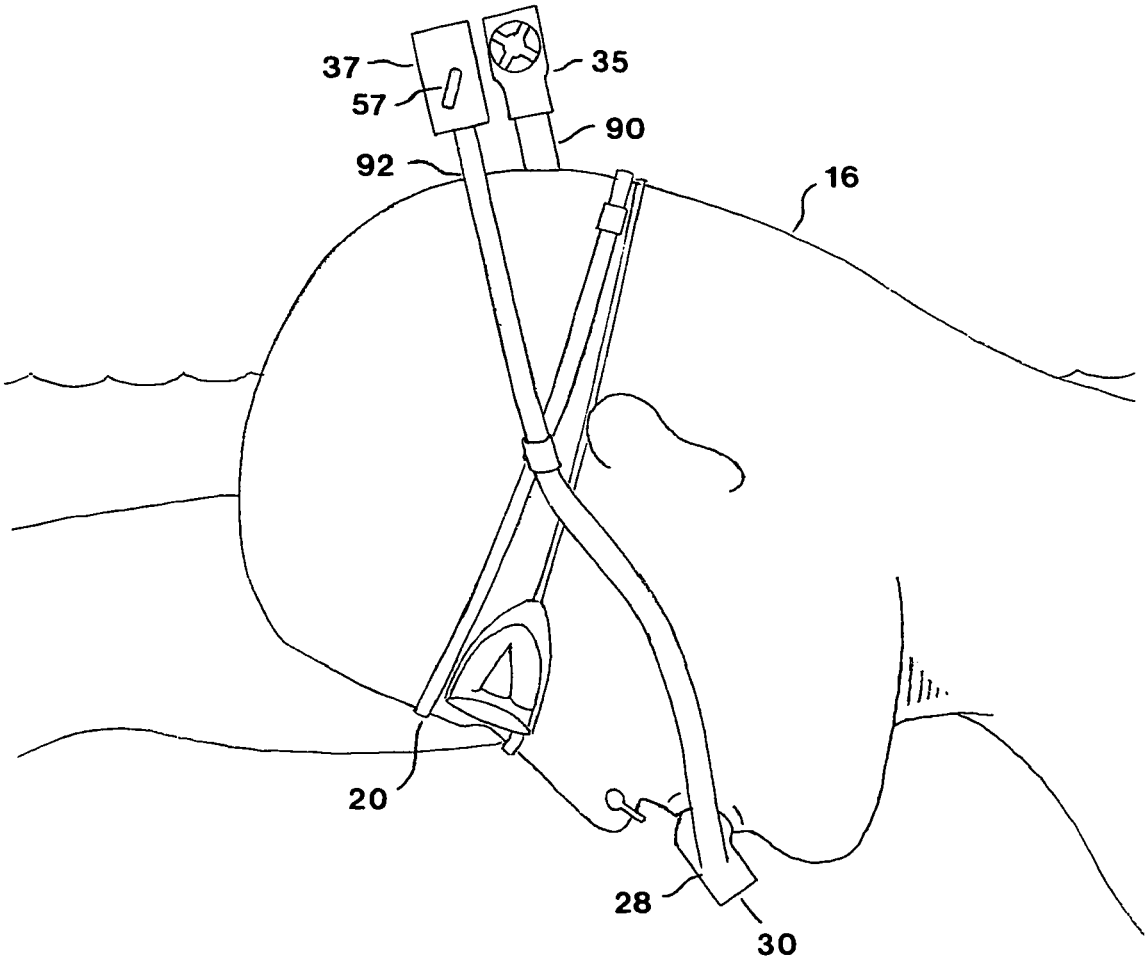
FIG. 6 is a side view of a second embodiment of the invention.
Figure 7:
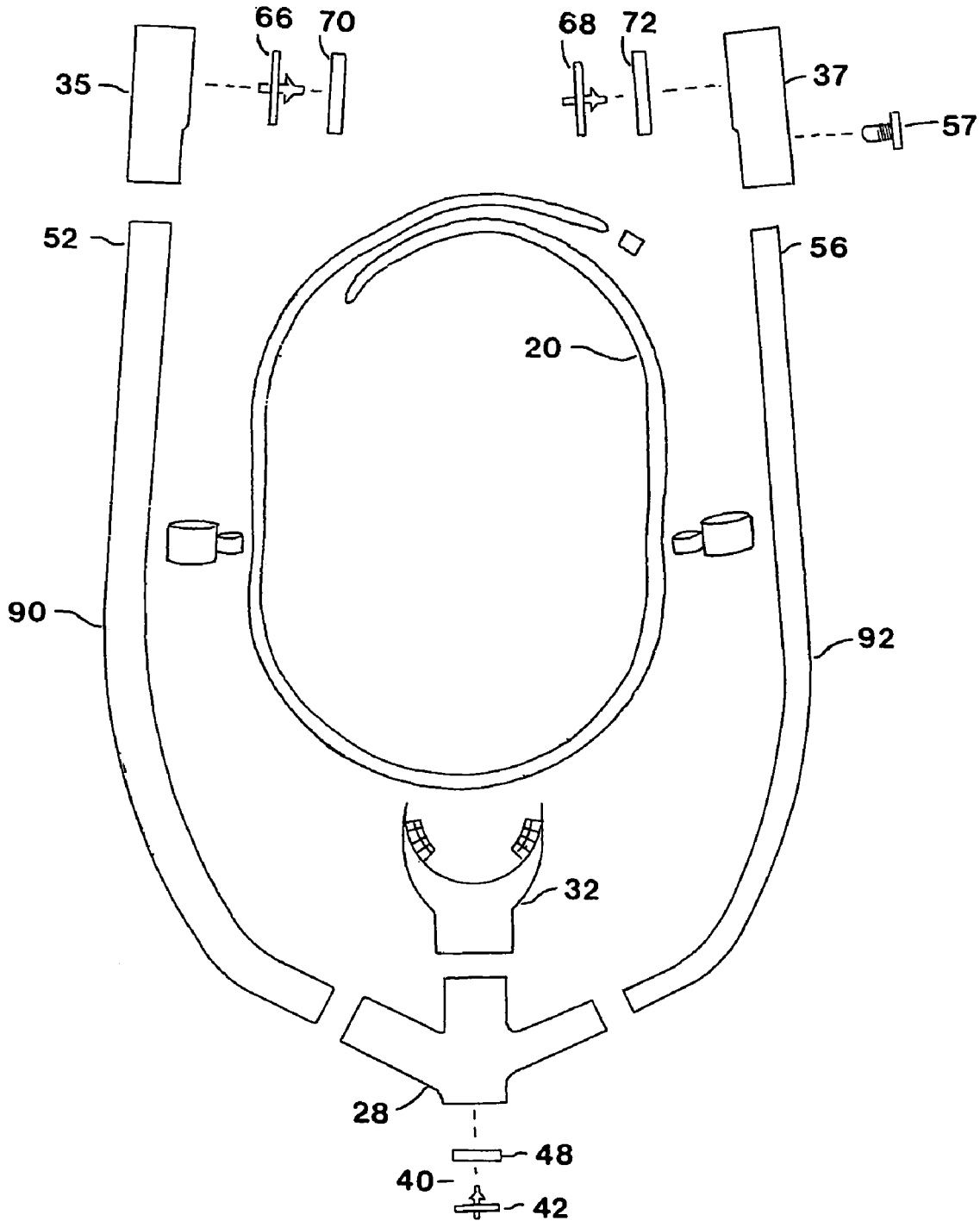
FIG. 7 is a top exploded view of the embodiment shown in FIG. 6.

FIGS. 6 and 7 illustrate a second embodiment of the invention having a side-mount configuration. The intake and exhaust hollow tubes 90, 92 curve separately to follow either side of the swimmer's head 11, and adjustable threaded butterfly valve 57 is provided through the wall of exhaust chamber 37.

Alternately the separate intake and exhaust tubes 90, 92 could be secured on the same side of the head 11. Also, in all the described embodiments, there could be multiple intake tubes, exhaust tubes, intake valve assemblies, exhaust valve assemblies, adjustable valves and water purge valves. Also, in all the described embodiments, the intake and exhaust valve assemblies could be located at different locations along the intake and exhaust tubes. Also in all the described embodiments the adjustable threaded butterfly valve which changes the cross-sectional area of a portion of the exhaust tube or airway, could be replaced by any other type of valve or device which achieves a similar result at any point within the exhaust chamber, exhaust tube or exhaust tube port. Also in the described embodiments the hinge between the adjustable tube mounting element and the head brace which allows the head brace to rotate about its hinge axis could be replaced by any other type of hinge or device which allows the head brace to rotate about it's hinge axis. By "the cross-sectional area of the exhaust airway" is meant the cross-sectional area of the air passage formed by the tube or chambers, taken at right angles to the direction of air flow in the tube, excluding the thickness of the material from which the tube or chamber is formed.

The cross-sectional area of all or a portion of the exhaust tube 15 is selected so that during normal relaxed exhaling, air pressure does not increase sufficiently in the hollow chamber 28 to open the purge valve 40, however when air is exhaled with more force than normal, as in a short cough, air pressure rises in the chamber 28 that causes the purge valve 40 to open and release a small amount of air and any accumulated water. In this way the separate air intake and exhaust tubes are regulated by one-way valves to prevent the swimmer from breathing exhaled air. At the same time the swimmer can control the one-way purge valve by the amount of force applied to each exhalation, so that the purge valve stays closed when the swimmer exhales with an average amount of force while swimming in a relaxed manner, but opens when the swimmer exhales with more force than normal to expel a small amount of air and almost all the accumulated water. The object of the invention is achieved by selecting the cross-sectional area of the exhaust tube so that all or a portion of the exhaust tube has a cross-sectional area which is large enough so that a swimmer can exhale normally through the tube while swimming without having to use extra exhaling force, yet sufficiently small to cause the purge valve 40 to open when a swimmer exhales with more force than normal to purge accumulated water.

For purposes of this disclosure, an "exhalation with more force than normal" means either (a) the swimmer exhales with a quick spitting-like action moving a small volume of air at relatively high velocity, or (b) the swimmer inhales an average volume of air and tightens his/her diaphragm to force the air out of the lungs at higher speed than normal, or (c) the swimmer inhales a larger volume of air than normal which the lungs then release at higher speed than normal without the swimmer having to tighten his/her diaphragm to force out the air.

The amount of exhaling force needed to open the water purge valve can be changed by rotating the threaded butterfly valve 57 which changes the cross-sectional area of a portion of the exhaust tube and changes the amount of exhaling force needed to open the water purge valve, so that children and others whose forceful exhalations are below average in strength, can reduce the amount of exhaling force needed to open the water purge valve, and swimmers like competitive racers who want their average exhalations to be with larger amounts of force without causing the water purge valve to open, can increase the amount of exhaling force needed to open the water purge valve.

For the disclosed embodiment, where the length of the exhaust tube 15 is about 14 inches, it has been found that the exhaust tube 15 can be effective having a cross-sectional area of the entire tube, or a section of the tube, between 0.130 square inch (0.406 inch circular diameter) and 0.306 square inch (0.625 inch circular diameter). The section of the exhaust tube with the smallest cross-sectional area needs to be greater than 0.130 square inch in cross-sectional area so that a swimmer, while swimming in a normal relaxed manner, can exhale using an average amount of force without having to exert an extra amount of exhaling force, and relaxed exhalations will not raise pressure in chamber 28 sufficiently to open the water purge valve 40. If the exhaust tube cross-sectional area is between 0.130 and 0.172 square inch, the purge valve opens with only a slight amount of added exhalation force, so users must control their relaxed exhalations to prevent the water purge valve from opening. As the exhaust tube cross-sectional area increases from 0.172 square inch to 0.306 square inch, relaxed exhaling becomes easier, but an increasing amount of exhaling force is needed to open the purge valve. If the exhaust tube cross-sectional area is more than 0.306 square inch, a swimmer needs to use a large amount of exhaling force to open the water purge valve, which expends energy and interrupts the swimming rhythm.

It has been found that for exhaust tubes that are the same cross-sectional area, there is no difference in the amount of exhalation force needed to open the water purge valve between the 14 inch length of the disclosed embodiment and the 13.5 inch length of the side-mounted configuration shown in FIG. 6.

Thus it has been found that the exhaust tube can be effective having a cross-sectional area between 0.130 square inch (0.406 inch circular diameter) and 0.306 square inch (0.625 inch circular diameter), that a range of 0.18 square inch to 0.26 square inch is preferred, and that the most preferred exhaust tube cross-sectional area, which allows relaxed exhaling and easy water purges, is about 0.22 square inch (0.53 inch circular diameter).

Besides using an exhaust tube with a uniform inside diameter, another method to increase air pressure during forceful exhalations sufficient to open the water purge valve, is by constricting a portion of the exhaust tube 15. It was found that exhaling is not impaired and the purge valve 40 will open with forced exhalations if a tube that is greater than 0.306 square inch in cross-sectional area (0.625 inch circular diameter) is constricted at some point along it's length to between 0.137 square inch in cross-sectional inside area (0.417 inch circular diameter) and 0.287 square inch in cross sectional area (0.605 inch circular diameter).

It was also found that the optimum cross-sectional area of a tube larger than 0.306 square inch with a constriction, is a uniform-diameter tube 0.44 square inch in cross-sectional area (0.75 inch in diameter) which has a constriction along an approximately 0.2 inch length of tube that is 0.23 square inch in cross-sectional area (0.541 inch in diameter). This is almost the same area as the optimum cross-sectional inside area of a uniform diameter tube which is 0.22 square inch.

The adjustable tube-mounting element 26 is attached by a hinge to the forehead brace 22 to allow pivoting only about an axis perpendicular to the breathing tube 14 so that the entire forehead brace will make contact with the swimmer's forehead and press more firmly against the forehead to prevent the forehead brace from moving when the breathing tube 14 jogs or veers to one side in the water. The hinged forehead brace will thus fit snugly against the swimmer's forehead independently of the shape of the forehead.

While the preferred embodiment of the invention has been described with respect to the cross-sectional area of a single exhaust tube, the objects of the invention will also be achieved where instead of a single exhaust tube, an exhaust airway comprising multiple tubes or passageways is provided. In that case the relevant cross-sectional area is the total combined area of the multiple tubes or passageways forming the exhaust airway.

As will be apparent to those skilled in the art in the light of the foregoing disclosure, many alterations and modifications are possible in the practice of this invention without departing from the spirit or scope thereof. While a circular exhaust tube has been disclosed, it was found that exhaust tubes of different cross-sectional shapes, such as oval, square, star, rectangular, or other shapes can have the same affect as a round tube to facilitate relaxed exhaling and control of water purging. Where the length of the snorkel tube is greater or less than that disclosed or for use by children or adults of abnormal size, the preferred cross-sectional area will vary somewhat. Also, whereas a butterfly-type valve has been disclosed for adjustment, other means for changing the cross-sectional area would also be suitable, such as ball valves, gate valves, or other adjustable valves or devices. Also whereas a single axis hinge has been disclosed to allow movement of the head brace about the axis defined by the hinge rod, other means for hingedly connecting the head brace to the tube or the tube-mounting element would also be suitable, such as providing a flexible material between the head brace and the tube or the tube-mounting element which allows pivoting only about an axis perpendicular to the breathing tube. Accordingly, the scope of the invention is to be construed in accordance with the substance defined by the following claims.

What is claimed is:

1. A swimming snorkel for use by a swimmer while swimming on or adjacent the surface of the water comprising:

(a) a mouthpiece;

(b) an elongated hollow intake airway having upper and lower ends and communicating between said mouthpiece and air outside said snorkel;

(c) a one-way intake valve means in said intake airway for permitting the intake of air and preventing the exhaust of air;

(d) an elongated exhaust airway having upper and lower ends and communicating between said mouthpiece and air outside said snorkel;

(e) one-way exhaust valve means in said exhaust airway for preventing the intake of air and permitting the exhaust of air;

(f) a hollow chamber communicating with said mouthpiece and said lower ends of said intake airway and said exhaust airway and communicating with a purging passage for purging air and water;

(g) one-way purge valve means in said purging passage for preventing the intake of air or water and permitting the exhaust of air and water;

(h) means for releasably securing said snorkel to the head of said swimmer, whereby said mouthpiece is held in the mouth of said swimmer and said upper ends of said intake airway and said exhaust airway extend above the surface of the water when the head and body of said swimmer are on or adjacent to the surface of the water;

wherein said exhaust airway has a cross-sectional area selected to be sufficiently small in at least one section thereof to cause said one-way purge valve to open to release accumulated water when a swimmer exhales with more force than normal, and large enough so that the swimmer can exhale in a normal manner through said exhaust airway while swimming without opening said one-way purge valve means;

wherein said cross-sectional area of said exhaust airway in said at least one section thereof is between 0.130 square inch and 0.306 square inch.

2. The snorkel of claim 1 wherein said cross-sectional area of said exhaust airway in said at least one section thereof is between 0.18 square inch and 0.26 square inch.

3. The snorkel of claim 1 wherein said cross-sectional area of said exhaust airway in said at least one section thereof is about 0.22 square inch.

4. The snorkel of claim 1 wherein the cross-sectional area of said intake airway is greater than about 0.44 square inch.

5. The snorkel of claim 1 wherein said means for releasably securing said snorkel to the head of said swimmer comprises elongated flexible strap means secured to a brace adapted to rest firmly against the swimmer's forehead to reduce movement of said intake and exhaust airways.

6. The snorkel of claim 5 wherein said brace is hingedly connected to said intake and exhaust airways by hinge means pivotable about an axis perpendicular to said intake and exhaust airways.

7. The snorkel of claim 5 wherein said means for releasably securing said snorkel to the head of said swimmer further comprises connecting means connecting said brace to said intake and exhaust airways.

8. The snorkel of claim 7 wherein said connecting means is hingedly connected to said intake and exhaust airways by hinge means pivotable about an axis perpendicular to said intake and exhaust airways.

9. A swimming snorkel for use by a swimmer while swimming on or adjacent the surface of the water comprising (a) a mouthpiece;

(b) an elongated hollow intake airway having upper and lower ends and communicating between said mouthpiece and air outside said snorkel;

(c) a one-way intake valve means in said intake airway for permitting the intake of air and preventing the exhaust of air;

(d) an elongated exhaust airway having upper and lower ends and communicating between said mouthpiece and air outside said snorkel;

(e) one-way exhaust valve means in said exhaust airway for preventing the intake of air and permitting the exhaust of air;

(f) a hollow chamber communicating with said mouthpiece and said lower ends of said intake airway and said exhaust airway and communicating with a purging passage for purging air and water;

(g) one-way purge valve means in said purging passage for preventing the intake of air or water and permitting the exhaust of air and water;

(h) means for releasably securing said snorkel to the head of said swimmer whereby said mouthpiece is held in the mouth of said swimmer and said upper ends of said intake airway and said exhaust airway extend above the surface of the water when the head and body of said swimmer are on or adjacent to the surface of the water;

wherein said exhaust airway has a cross-sectional area selected to be sufficiently small in at least one section thereof to cause said one-way purge valve to open to release accumulated water when a swimmer exhales with more force than normal, and large enough so that the swimmer can exhale in a normal manner through said exhaust airway while swimming without opening said one-way purge valve means wherein said exhaust airway comprises means for adjusting said cross-sectional area of said at least one section of said exhaust airway; and wherein said exhaust airway comprises means for adjusting said cross-sectional area of said at least one section of said exhaust airway.

10. The snorkel of claim 9 wherein said means for adjusting said cross-sectional area comprises valve means extending into the interior of said exhaust airway.

11. The snorkel of claim 10 wherein said means for adjusting said cross-sectional area comprises rotatable valve means extending into the interior of said exhaust airway.

12. A method of using a swimming snorkel by a swimmer while swimming on or adjacent the surface of the water comprising:

(a) providing a snorkel comprising (i) a mouthpiece;

(ii) an elongated hollow intake airway having upper and lower ends and communicating between said mouthpiece and air outside said snorkel;

(iii) one-way intake valve means in said intake airway for permitting the intake of air and preventing the exhaust of air;

(iv) an elongated exhaust airway having upper and lower ends and communicating between said mouthpiece and air outside said snorkel;

(v) one-way exhaust valve means in said exhaust airway for preventing the intake of air and permitting the exhaust of air;

(vi) a hollow chamber communicating with said mouthpiece and said lower ends of said intake airway and exhaust airway and communicating with a purging passage for purging air and water;

(vii) one-way purge valve means in said purging passage for preventing the intake of air or water and permitting the exhaust of air and water;

(viii) means for releasably securing said snorkel to the bead of said swimmer, whereby said mouthpiece is held in the mouth of said swimmer and said upper ends of said intake airway and said exhaust airway extend above the surface of the water when the head and body of said swimmer are on or adjacent to the surface of the water; and b) selecting the cross-sectional area of said exhaust airway in at least one section thereof to be sufficiently small to cause said one-way purge valve to open to release accumulated water when a swimmer exhales with more force than normal, and large enough so that the swimmer can exhale in a normal manner through said exhaust airway while swimming without opening said one-way purge valve means wherein said selection is made by adjusting valve means extending into the interior of said exhaust airway.

13. The method of claim 12 wherein said adjustable selection is made by rotating valve means extending into the interior of said exhaust airway.

* * * * *